United States Patent [19]

Kellner

[11] 4,211,291

[45] Jul. 8, 1980

[54] DRILL FLUID POWERED HYDRAULIC SYSTEM

[75] Inventor: Jackson M. Kellner, Midland, Tex.

[73] Assignee: Smith International, Inc., Newport Beach, Calif.

[21] Appl. No.: 883,482

[22] Filed: Mar. 6, 1978

[51] Int. Cl.[2] ..... E21B 7/00

[52] U.S. Cl. ..... 175/17; 175/107; 175/93; 173/DIG. 4; 91/470; 60/698

[58] Field of Search ..... 175/93, 94, 92, 95, 175/103, 106, 107, 17; 173/DIG. 4; 60/416, 698; 91/4 A, 4 R, 468, 470

[56] References Cited

U.S. PATENT DOCUMENTS

| | | | |
|---|---|---|---|
| 1,084,762 | 1/1914 | Stewart | 175/107 X |
| 1,391,626 | 9/1921 | Gilthorpe | 175/106 X |
| 2,827,263 | 3/1958 | Scott et al. | 175/93 |
| 2,937,008 | 5/1960 | Whittle | 175/107 X |
| 3,100,965 | 8/1963 | Blackburn | 91/4 R |
| 3,596,722 | 8/1971 | Allard | 175/93 |
| 4,016,719 | 4/1977 | Yavnai | 60/416 |
| 4,051,909 | 10/1977 | Baum | 175/107 X |
| 4,098,359 | 7/1978 | Birdwell | 175/93 |

FOREIGN PATENT DOCUMENTS

| | | | |
|---|---|---|---|
| 735818 | 4/1943 | Fed. Rep. of Germany | 175/93 |
| 120189 | 11/1959 | U.S.S.R. | 175/93 |

*Primary Examiner*—Ernest R. Purser
*Assistant Examiner*—Richard E. Favreau
*Attorney, Agent, or Firm*—Murray Robinson; Ned L. Conley; David A. Rose

[57] ABSTRACT

A drill fluid powered hydraulic system used for driving a shaft connected to a drill bit is disclosed. The apparatus includes a hydraulic fluid powered motor actuated and controlled by hydraulic fluid. The hydraulic fluid is supplied to the hydraulic fluid powered motor through an intermediate drive system actuated by drill fluid. The intermediate drive system is provided with two rotary valves and two double sided accumulators. One of the rotary valves routes the hydraulic fluid to and from the accumulators and respectively from and to the hydraulic fluid powered motor. The other valve routes the drill fluid to the accumulators from the drill fluid supply and from the accumulators to the drill bit. The rotary valves are indexed by a gear system and Geneva drive connected to the motor or drill shaft. A heat exchanger is provided to cool the hydraulic fluid. The heat exchanger has one side of the exchange piped between the drill fluid inlet and the drill fluid rotary valve and the other side of the exchange piped between the hydraulic fluid side of the accumulators and the hydraulic fluid rotary valve.

8 Claims, 3 Drawing Figures

DRILL FLUID POWERED HYDRAULIC SYSTEM

BACKGROUND OF THE INVENTION

1. Field of the Invention

This invention relates to hydraulic fluid powered motor systems.

2. Description of the Prior Art

It has long been the practice to use fluid drive systems for motors. It has also been known in the prior art to actuate the drive system by a gas such as air. Typical examples thereof in the prior art are:

U.S. Pat. No. 2,970,655, issued Feb. 7, 1961, to R. D. Action;

U.S. Pat. No. 3,276,330, issued Oct. 4, 1966, to H. H. Johnson;

U.S. Pat. No. 3,415,159, issued Dec. 10, 1968, to R. Hornlein, et al;

U.S. Pat. No. 3,507,189, issued Apr. 21, 1970, to D. B. Beckett, et al;

U.S. Pat. No. 3,722,365, issued Mar. 27, 1973, to S. O. Olsson; and

U.S. Pat. No. 3,779,132, issued Dec. 18, 1973, to T. W. Otto.

The Action, Johnson, Hornlein, Beckett, and Olsson devices do not, however, use the motor to control a valving operation of the gas.

The Otto device uses the motor to control the valving operation to alternate the direction of gas flow. However, the Otto device does not use the motor to control drive fluid outlets to maintain a unidirectional flow of fluid to the motor. Also, Otto does not disclose the use of the unidirectional flow of drill fluid to power or actuate the drive fluid. Additionally, the motor drive of Otto is not used in a drilling environment. Also a heat exchanger is not disclosed in Otto. Moreover, a gearing system is not disclosed in Otto.

SUMMARY OF THE INVENTION

The problems of driving a drill bit with a closed, unidirectional fluid drive system are solved by the drill fluid powered hydraulic system of the present invention. The present invention uses oil or other hydraulic drive fluid to actuate a hydraulically actuated motor to rotate a drill bit. A drill fluid such as water or drilling mud is used in conjunction with a fluid interface system to provide continuous flow of the hydraulic drive fluid. The drill fluid is also used to cool the hydraulic drive fluid. The drill fluid may also exit through the drill bit as a drilling mud. The shaft of the hydraulically actuated motor is used to control the hydraulic drive fluid and the disposal of the drill fluid through the fluid interface system.

BRIEF DESCRIPTION OF THE DRAWING

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EMBODIMENT

Introduction

The preferred embodiment of the drill fluid powered hydraulic system of the present invention may be used to drive a drill bit with a hydraulically actuated motor wherein the supply of hydraulic actuating fluid is limited and contained within a closed portion of the system. The system uses the motor shaft to coordinate the supply and direction of hydraulic actuating fluid to the motor through a fluid interface portion of the system. The system may also supply drilling fluid to the bit. A particularly important area of application of the present invention is the use of the drilling fluid, prior to its entry into the bit, to supply power to the fluid interface portion of the system. However, it should be realized that the present invention could be applied to, for example, any application wherein it is desired to rotate a fluid driven motor using the motor's shaft to control the flow of fluid used to drive the motor.

In the preferred embodiment of the present invention, the fluid interface system controls the flow of hydraulic fluid to the hydraulic motor through a pair of dual chamber piston accumulators, one of the chambers of each being connected to the motor by a rotary valve. Hydraulic fluid is contained in the chambers of each of the accumulators connected to the motor. The fluid interface system also controls the flow of drilling fluid through the other set of chambers of the dual chamber piston accumulators which are connected between the drill fluid supply and the drill bit by another rotary valve. Drilling fluid is introduced into the chambers of the pistons controlling the drilling fluid. The position of the rotary valves is coordinated by the shaft of the motor.

Structure and Its Method of Use

Figure 1:
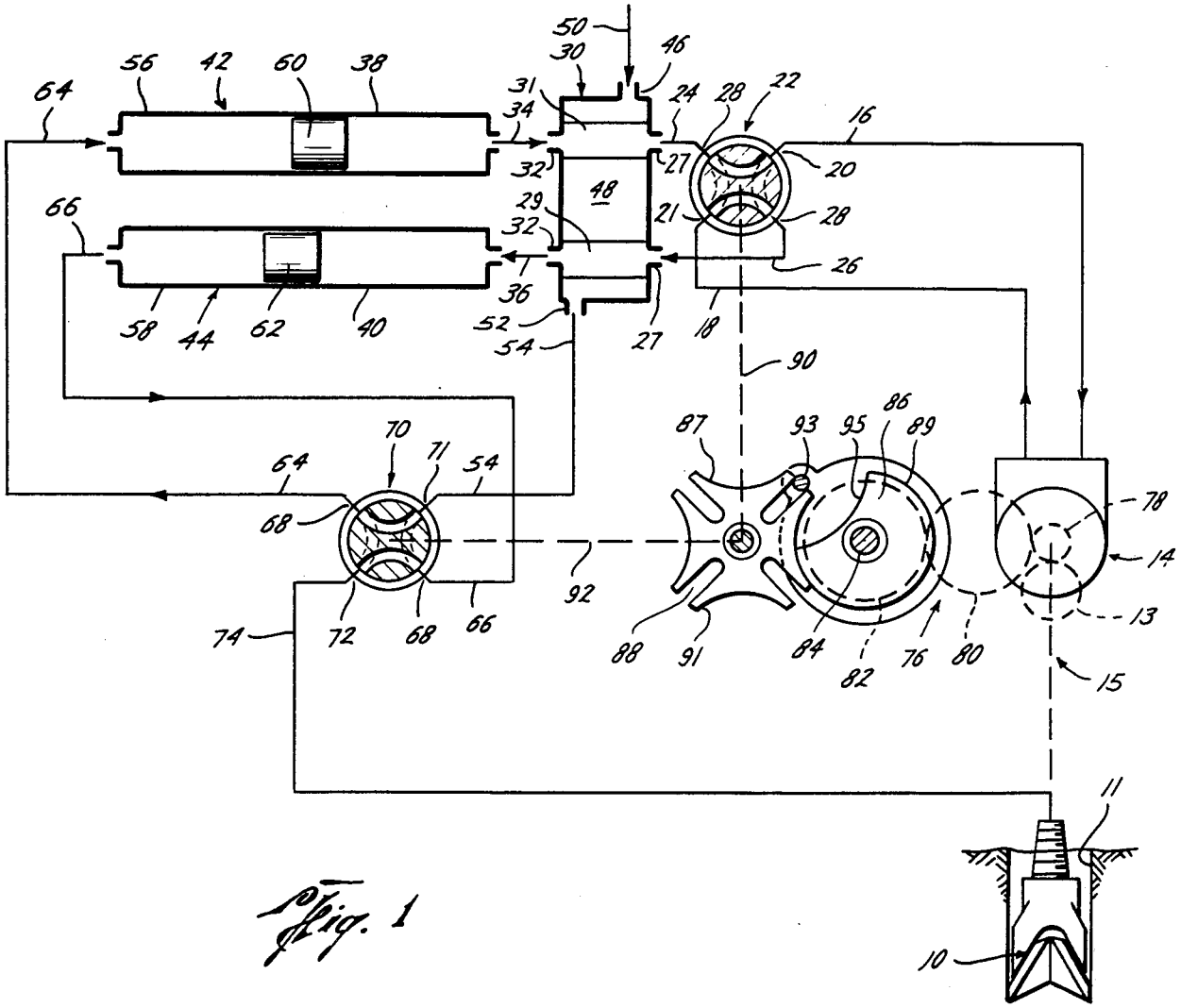
FIG. 1 is a schematic drawing of the hydraulic circuit and mechanical components of the preferred embodiment of the drill fluid powered hydraulic system of the present invention.
Figure 2:
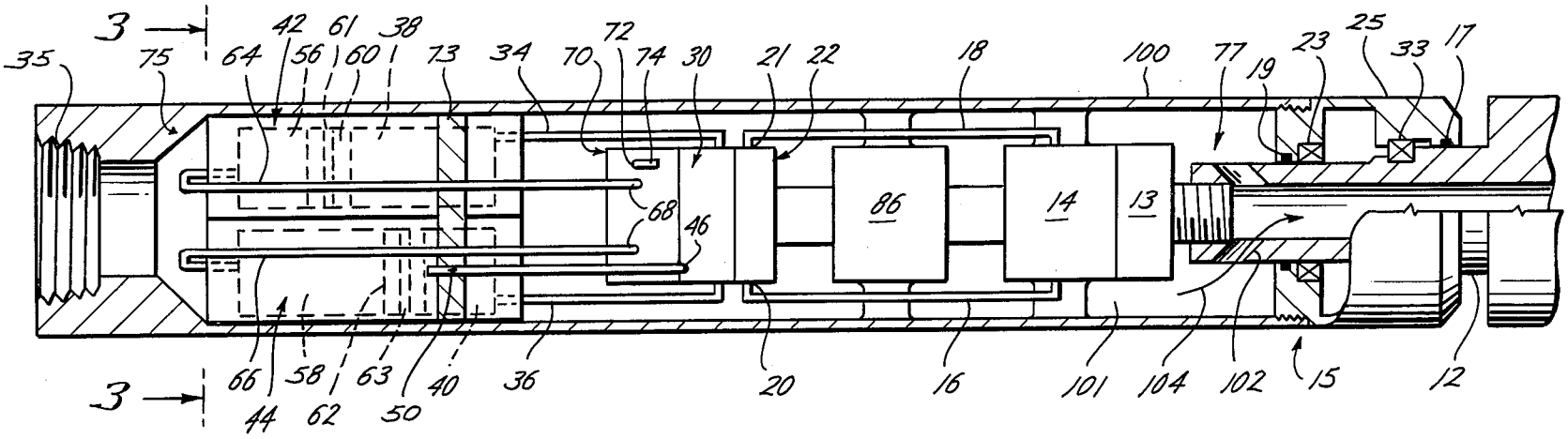
FIG. 2 is a side cross sectional view of an in-hole drill apparatus of the preferred embodiment of the drill fluid powered hydraulic system of the present invention.
Figure 3:
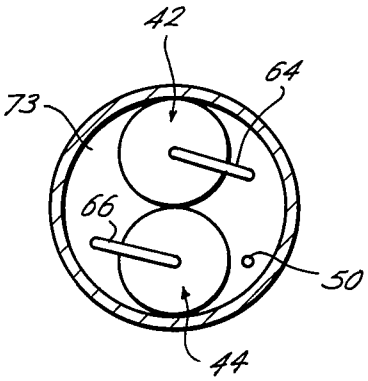
FIG. 3 is a cross sectional view of the in-hole drill apparatus of the preferred embodiment of the drill fluid powered hydraulic system of the present invention taken along section line 3—3 of FIG. 2.

As illustrated in FIGS. 1 and 2, a drill bit 10 in hole 11 is powered through shaft 12 of shaft system 15 by fluid powered motor 14. Shaft system 15 further includes seals 17, 19 and bearings 23, 33 in housing 25. Gear box and fly wheel combination 13 interfaces fluid powered motor 14 with shaft system 15. Fluid powered motor 14 is powered by fluid such as, for example, hydraulic fluid supplied by inlet line 16, which is connected to motor 14. The fluid exits from motor 14 by outlet line 18 connected to motor 14. Lines 16, 18 are also connected to the outlet port 20 and inlet port 21 respectively of a rotary valve 22. Rotary valve 22 is well known in the art. See, for example, Model 4V6C, Rotary Shear Seal Valve, manufactured by Rogers Co. and sold by Womack Machine Supply Co. of Dallas, modified for full rotation.

The intermediate ports 28 of rotary valve 22 are connected to one set of ends of hydraulic fluid supply and return lines 24, 26. The other set of ends of supply and return lines 24, 26 are connected to ends 27 of the tube bundles 29, 31 of heat exchanger 30. The other ends 32 of the tube bundles 31, 29 of heat exchanger 30 connect to hydraulic fluid inlet/outlet lines 34, 36 respectively of the hydraulic fluid chambers 38, 40 of accumulators 42, 44 respectively. The inlet portion 46 of the shell side 48 of the heat exchanger 30 is connected to the drill bit fluid supply line 50. The outlet portion 52 of the shell side 48 of heat exchanger 30 is connected to intermediate drill bit fluid line 54.

Accumulators 42, 44 also include drill bit fluid chambers 56, 58 respectively, and reciprocating sealed pistons 60, 62 respectively. Sealed pistons 60, 62 includes seals 61, 63. Seal 61 divides accumulator 42 into chambers 38, 56 respectively, and seal 63 divides accumulator 44 into chambers 40, 58 respectively. Chambers 38, 40 should be of sufficient size to retain fluid for starting motor 14.

Drill bit fluid chambers 56, 58 are connected to one end of each drill bit fluid inlet/outlet transfer line 64, 66 respectively. The other end of each drill bit fluid inlet/-outlet transfer line 64, 66 is connected to an intermediate side 68 of rotary valve 70. The physical structure of rotary valve 70 is the same as that of rotary valve 22. The inlet port 71 of rotary valve 70 is connected to and receives fluid from drill bit fluid line 54. The outlet port 72 of rotary valve 70 is connected to one end of drill bit fluid supply line 74. The other end of drill bit fluid supply line 74 supplies drill fluid to shaft 12.

If 14 is a downhole motor, shaft 12 would be mounted in housing or mandrel 100, and directly attached to gear box, fly wheel 13 (FIG. 2). Mandrel 100 is adapted by threaded connection 35 to connect to a drill string (not shown). Seal 73 is formed in mandrel 100 about accumulators 42, 44 to prevent fluid from flowing between the upper portion 75 and lower portion 77 of mandrel 100 except through drill bit fluid supply line 50. Drill bit fluid supply line 74 would supply drill fluid to channel 101 formed about motor 14 in lower portion 77. Channel 101 is in fluid communication with inlet channel 102 in shaft 12. Channel 102 is in fluid communication with the drill bit 10. The flow of drill bit fluid would be as shown by direction line 104.

Should the rate of hydraulic fluid flow through motor 14 be insufficient to provide sufficient drill bit fluid, the drill bit fluid side of accumulators 42, 44 may be expanded to provide more fluid and dual pistons used in each accumulator 42, 44 instead of sealed pistons 60, 62. Each of the dual pistons would include a first piston having a first diameter substantially equal to the diameter of chambers 38, 40 and a second piston having a second diameter substantially equal to the diameter of chambers 58, 60. The first and second pistons would be mechanically linked, and each piston would have a seal substantially like seals 61, 63. Another way of supplying more fluid would be to insert orifices in seal 73 to permit the flow of drill bit fluid from upper portion 75 to lower portion 77. Care must be taken in supplying these orifices so that there is sufficient pressure drop across each orifice to also permit drill bit fluid to flow from pipe 50 through the drill fluid powered hydraulic system to drill bit fluid supply line 74.

Gear system 76 is connected between shaft 12 and motor 14 and between valves 22, 70 and motor 14. Gear system 76 comprises a first set of gears 78 attached to the shaft of the motor 14. First set of gears 78 includes teeth engaging the teeth of a second gear 80 for the gear interface between valves 22, 70 and motor 14. Second gear 80 preferably has a diameter larger than first gears 78. Second gear 80 includes teeth engaging the teeth of third gear 82, the diameter of third gear 82 preferably being larger than the diameter of second gear 80. Third gear 82 includes shaft 84 upon which Geneva driver wheel is also splined or connected. Geneva driver wheel 86 cooperates with Geneva follower 87. The outer arcuate surface 89 of Geneva driver wheel 86 has substantially the same radius of curvature as the outer arcuate surface 91 of Geneva follower 87. Pin 93 of Geneva driver wheel 86 enters a slot 88 of Geneva follower 87 tangentially with each revolution. Geneva follower 87 then rotates until pin 93 leaves slot 88. In order that Geneva follower 87 may rotate while pin 93 is in slot 88, the Geneva driver wheel 86 is hollowed at 95 to clear Geneva follower 87, as is well known in the art. See, for example *Kinematics of Machinery* by C. D. Albert and F. S. Rogers, John Wiley & Sons, Inc. 1931, pages 383–385 and Mechanisms, Linkages and Mechanical Controls by M. P. Chironis, McGraw-Hill 1965, pages 26–36. Indexing shaft 90 connects Geneva follower 87 to rotary valve 22. Indexing shaft 92 connects Geneva follower 87 to rotary valve 70. For example, valves 22, 70 may be coaxial with and have their rotary mechanism splined or attached by other means to Geneva follower 87.

First set of gears 78 also includes teeth engaging teeth of gears in gear box fly wheel combination 13 for the gear interface between shaft 12 and motor 14. Gear box fly wheel combination 13 in turn rotates shaft 12.

In operation, drill bit fluid, such as, for example, water, in line 50 is introduced into the shell side 48 of heat exchanger 30. In exchanger 30, the drill bit fluid in shell side 48 cools the hydraulic fluid, such as, for example, oil, by heat exchange with the hydraulic fluid in tubes 29, 31. The drill bit fluid exits exchanger 30 through intermediate drill bit fluid line 54 and thence through the inlet port 71 of rotary valve 70. Rotary valve 70 is capable, depending on its position, of diverting the flow from line 54 to either of the drill bit fluid inlet/outlet transfer lines 64, 66 on the intermediate side 68 of rotary valve 70. Presuming that rotary valve 70 is in the position shown by the solid lines of FIG. 1, diverting drill bit fluid from intermediate line 54 to transfer line 64, drill bit fluid from intermediate line 54 flows into line 64 and thence to the drill bit fluid chamber 56 of accumulator 42. The entrance of the drill bit fluid under pressure will force reciprocating sealed piston 60 to diminish the volume in hydraulic fluid chamber 38 of accumulator 42, thereby forcing additional hydraulic fluid into hydraulic fluid inlet/ outlet line 34. The hydraulic fluid from line 34 passes through the tubes 31 of heat exchanger 30 and thence to port 28 of rotary valve 22. Geneva mechanism 86, 87 coordinates the stepping of rotary valves 22, 70 so that when line 54 is connected by rotary valve 70 to line 64, line 24 is connected by valve 22 to inlet line 16 of rotary valve 22 as shown by the solid lines in FIG. 1. Therefore, hydraulic fluid passes from line 24 to line 16. The hydraulic fluid is then conveyed to motor 14 to drive motor 14. The exhausted hydraulic fluid is conveyed from motor 14 by outlet line 18. The hydraulic fluid passes from outlet line 18 through rotary valve 22 and line 26 through the tubes 29 of heat exchanger 13 and hydraulic fluid inlet/outlet line 36 into hydraulic fluid chamber 40 of accumulator 44. The hydraulic fluid forced into hydraulic fluid chamber 40 forces reciprocating sealed piston 62 to diminish the volume in drill bit fluid chamber 58, thereby driving the drill bit fluid into line 66. Drill bit fluid flows through line 66 and rotary valve 70 to line 74 and from there through shaft 12 into bit 10. The drill bit fluid flowing through bit 10 is used to wash away particles in the hole 11 which wash back up through the hole 11 and the return line (not shown).

After sufficient drill bit fluid is supplied to drill bit fluid chamber 56, reciprocating sealed pistons 60, 62 will have reached the extremes of their travel at opposite ends of accumulators 60, 62 respectively. This travel distance and flow rate are synchronized with the frequency of rotation of Geneva follower 87 through gear system 76. When reciprocating sealed pistons 60, 62 have reached such extreme positions, the roles of lines 64, 66 and 24, 26 will be switched by rotary valves 70, 22 respectively driven by indexing shafts 90, 92. The momentum of the fly wheel (not shown) of combination 13 will force Geneva mechanism 86, 87 through the short switching transition of valves 22, 70 when the port mechanisms are sealed in transit. Therefore, after the valves are switched by Geneva mechanism 86, 87 to the position indicated by the dashed lines at FIG. 1, drill bit fluid from line 54 would be diverted to line 66 forcing drill bit fluid into drill bit fluid chamber 58. The additional drill bit fluid will force piston 62 to drive hydraulic fluid out of chamber 40. The hydraulic fluid would then travel through line 36, tubes 29, line 26, rotary valve 22, and inlet line 16 to the motor 14. Hydraulic fluid from outlet line 18 would then travel through rotary valve 22, line 24, tubes 31, and line 34 to chamber 38. The influx of hydraulic fluid into chamber 38 will drive drill bit fluid out of chamber 56 by the use of reciprocating sealed piston 62. Drill bit fluid from chamber 56 would then travel through line 64, rotary valve 70, and line 74 to shaft 12 and drill bit 10 and returned to the surface through the hole 11.

In this manner, the drill bit fluid is supplied constantly to bit 10 while being used both to supply driving force for hydraulic fluid used to drive motor 14 and to cool such hydraulic fluid.

Although the system described in detail supra has been found to be most satisfactory and preferred, many variations in structure and method are possible. For example, the fluid drive system does not have to be a closed system. Also, slide valves and piston rods could be used instead of a rotary motor. Moreover, the drill bit fluid does not have to be supplied to the drill bit. Additionally, the heat exchanger may have its cooling supplied independently of the drill bit fluid.

The above are exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A rotary drill shaft driving system, adapted to be connected to drill pipe providing a source of drill fluid to the system and useful for rotating a drill shaft having a bit connected at one end of the shaft, through the use of drill fluid supplied to said system, comprising:

a motor driven by hydraulic fluid flowing in only one direction and connected to such shaft means for rotation of such shaft;

drive means for supplying said hydraulic fluid flowing in said one direction;

actuation means adapted to receive drill fluid from said source and responsive to flow of said drill fluid for acutating said drive means; and coordination means responsive to rotation of such shaft for synchronizing flow of drill fluid to said actuation means with supply of hydraulic fluid to said drive means, said drive means including:

first supply means for holding and supplying only a fixed amount of said hydraulic fluid, and a first valve actuated by said coordination means for causing said flow of said fixed amount of said hydraulic fluid to be substantially smooth and unidirectional;

said first supply means being in fluid flow communication with said first valve, said actuating means including:

reciprocating sealed piston means, second supply means for receiving and supplying a fixed amount of said drill fluid, said piston means being located between said first and second supply means; and a second valve actuated by said coordination means and in fluid flow communication with said source of drill fluid and said second supply means, said second valve including an outlet and means for converting such discrete amounts of such drill fluid to a continuous flow of such drill fluid at said outlet.

2. The system of claim 1 wherein there is further included third supply means for supplying such drill fluid to such bit, said third supply means being connected to said outlet.

3. The system of claim 1 wherein said coordination means includes:

an indexing gear mounted on such shaft; and means actuated by said indexing gear for causing transition of said first valve and said second valve.

4. The system of claim 3 wherein said shaft means further includes means for causing said indexing gear to move during transition of said first and second valves.

5. The system of claim 1 wherein said drive means includes:

heat exchange means for extracting heat from said hydraulic fluid.

6. The system of claim 5 wherein said heat exchange means includes a heat exchanger and means for routing such drill fluid to said heat exchanger.

7. The system of claim 1 wherein such bit is used for drilling a hole and said motor is located in such hole.

8. The system of claim 7 wherein:

said motor is housed in a mandrel; and said motor and said shaft means are coaxial with such shaft.

* * * * *